United States Patent [19]

Tang

[11] Patent Number: 4,766,438

[45] Date of Patent: Aug. 23, 1988

[54] THREE DIMENSIONAL FEED THROUGH LENS WITH HEMISPHERICAL COVERAGE

[75] Inventor: Raymond Tang, Fullerton, Calif.

[73] Assignee: Hughes Aircraft Company, Los Angeles, Calif.

[21] Appl. No.: 20,003

[22] Filed: Feb. 27, 1987

[51] Int. Cl.[4] ..... H01Q 3/24; H01Q 19/06

[52] U.S. Cl. ..... 342/372; 342/374; 343/754

[58] Field of Search ..... 342/368, 371, 372, 373, 342/374; 343/754, 757, 777

[56] References Cited

U.S. PATENT DOCUMENTS

| | | | |
|---|---|---|---|
| 3,430,242 | 2/1969 | Safran | 342/371 |
| 4,044,360 | 8/1977 | Wolfson et al. | 343/754 |
| 4,580,140 | 4/1986 | Cheston | 342/372 |

*Primary Examiner*—Theodore M. Blum
*Assistant Examiner*—Gregory C. Issing
*Attorney, Agent, or Firm*—Thomas A. Runk; Anthony W. Karambelas

[57] ABSTRACT

A lens antenna having four phased array apertures positioned for hemispherical coverage is disclosed. An array of phase shifters is disclosed, each of which is interconnected with four radiating elements, one on each of the four apertures. A feed horn is used to feed the lens and switches in the lens are used to switch the energy received from the feed horn to the phase shifter, and after phase shifting, to a selected aperture for radiation. The switches also perform a reciprocal function by switching energy received at an aperture to the phase shifter and then to an aperture for radiation to the feed horn. In a further embodiment, the mounting of transmitting and receiving components, such as a high power amplifier and a low noise amplifier, with a combination of DPDT switches in the lens is disclosed and results in a solid state T/R type antenna array. In one embodiment, the switches enable the lens to radiate from three of the apertures for a scan angle of 270 degrees from a single feed horn. The addition of more feed horns per face results in multiple radiated beams from a single face.

17 Claims, 9 Drawing Sheets

THREE DIMENSIONAL FEED THROUGH LENS WITH HEMISPHERICAL COVERAGE

BACKGROUND OF THE INVENTION

The invention relates generally to antennas, and more particularly, to phased array antennas.

Phased array antennas have had wide application to many systems including radar systems. Antenna beams may be steered rapidly through a wide range of angles and mechanical rotation of the antenna, while it is an effective technique, is not necessary in many applications because of the scanning capabilities of phased array antennas. By controlling the phased array antenna with a computer, high scanning and data rates are possible and the antenna is able to simultaneously perform multiple, interlaced functions such as fire-control, surveillance, tracking and communications. A computer controlled phased array antenna is also capable of interacting with multiple targets simultaneously under a variety of conditions and its time allocation to particular targets can be adjusted to optimize performance in the particular application.

However phased array antennas have one well known disadvantage their expense. Due to this expense, which is typically very large, they are not used in many applications where they would be the best choice based on performance characteristics.

One of the most expensive parts of the phased array antenna is the phase shifter. In many prior techniques, each radiating element has its own phase shifter feeding it. In the case where a narrow antenna beam is desired, thousands of radiating elements are used and so thousands of accompanying phase shifters with control drivers are required. Not only is the expense of the individual phase shifter substantial, but the expense associated with installing, testing, and controlling each phase shifter is also large. Where hemispherical coverage is necessary and a mechanically rotating antenna is not desired, four phased array apertures or faces may be used. These four apertures result in a four-fold increase in the number of phase shifters in many prior techniques. In most cases, this would result in a prohibitively high cost not only in terms of component cost, but also in terms of labor costs for installation, alignment, and service of such a large number of components, and because of that cost, a phased array antenna would not be used.

Accordingly, it would be an advance in the art to provide a phased array antenna capable of hemispherical scan coverage without mechanical rotation but which uses fewer phase shifters than prior techniques and has substantially the same performance.

It is an object of the invention to provide an improved phased array antenna.

It is a further object of the invention to provide a phased array antenna capable of hemispherical scan coverage without using mechanical rotation and which uses fewer than one phase shifter per radiating element.

It is a further object of the invention to provide a phased array antenna capable of simultaneous hemispherical coverage without mechanical rotation and using fewer phase shifters than prior techniques.

It is a further object of the invention to provide a phased array antenna providing hemispherical scan coverage by means of four stationary apertures with sets of one radiating element from each aperture interconnected with a single phase shifter, and maintaining substantially the same performance as that of an antenna having four faces with one phase shifter per each radiating element.

It is a further object of the invention to provide a phased array antenna capable of simultaneous hemispherical coverage without mechanical rotation and using fewer phase shifters than prior techniques and which is adaptable to disposing transmit and receive components at the antenna aperture for functioning as a solid state array.

It is a further object of the invention to provide a phased array antenna capable of providing hemispherical scan coverage by means of four stationary apertures with sets of one radiating element from each aperture interconnected with a single phase shifter, and which is capable of simultaneously generating multiple beams from a single aperture.

SUMMARY OF THE INVENTION

These and other objects and advantages are attained by the invention wherein there is provided a space fed lens system having four faces, one phase shifter per four radiating elements and a system of switches to achieve hemispherical scan coverage.

The antenna comprises a three dimensional feed-through lens with illumination of the lens accomplished by an offset feed horn or horns. Feed horns are offset to minimize scan aperture blockage. In the preferred embodiment, the array faces are positioned ninety degrees from each other azimuthally, so that each face provides scan coverage over a quarter of a hemisphere. Each face of the lens comprises a two dimensional array of radiating elements such as, but not limited to, dipole radiators, open-ended waveguide radiators, or disk radiators. In one embodiment of the invention, four radiating elements, i.e., one from each face, are interconnected with a single phase shifter through two single pole, double throw (SPDT) switches. These radiating elements are corresponding elements and in one embodiment, the corresponding elements of each set of two faces occupy identical locations on their respective two dimensional antenna faces. Because there is only one phase shifter used for each group of four radiating elements in this embodiment, the number of phase shifters is one fourth of that required in a conventional radar using four faces for hemispherical coverage.

By use of the two SPDT switches, any feed horn illuminating any of the faces can cause radiation in two contiguous ninety degree sectors. Where fewer feed horns are desired, two feed horns instead of four may be used to provide hemispherical coverage. A pair of feed horns placed diametrically opposite each other would be used, each of which results in illumination from its opposite face and an adjacent face, the adjacent face being different for each horn. Thus, each horn provides one-half of the hemispherical coverage. Greater control of the switches is required, however.

In another embodiment of the invention, transmitting and receiving components may be incorporated into the lens itself. The two SPDT switches are replaced by four double pole, double throw (DPOT) switches and radiation from three faces by each feed horn is possible. Also, the use of high power amplifiers disposed in close proximity to the radiating aperture increases the effective radiated power on transmit, and the use of low noise amplifiers disposed in close proximity to the radiating aperture improves the radar signal-to-noise ratio on receive.

BRIEF DESCRIPTION OF THE DRAWINGS

Further features, advantages, and objects of the invention may be understood from the following detailed description taken in conjunction with the accompanying drawings in which.

Figure 3:
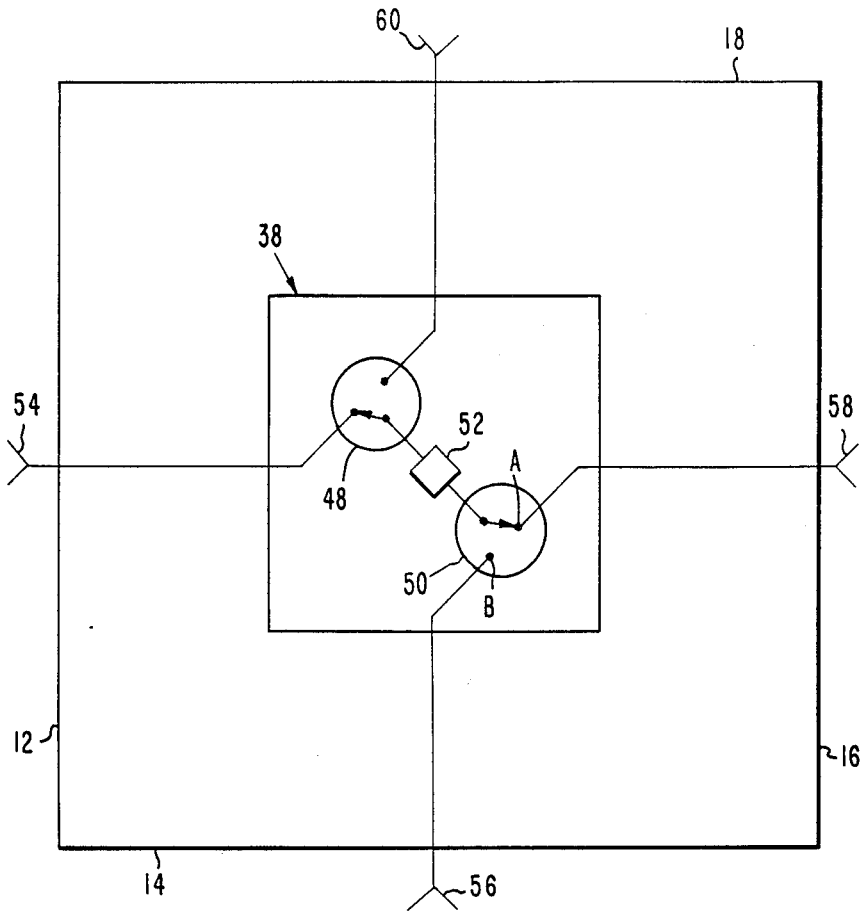
FIG. 3 is a diagram of an embodiment of the invention showing four radiating elements, one per face, a single phase shifter, and two SPDT switches which alternately connect the phase shifter to radiating elements.
Figure 4A:
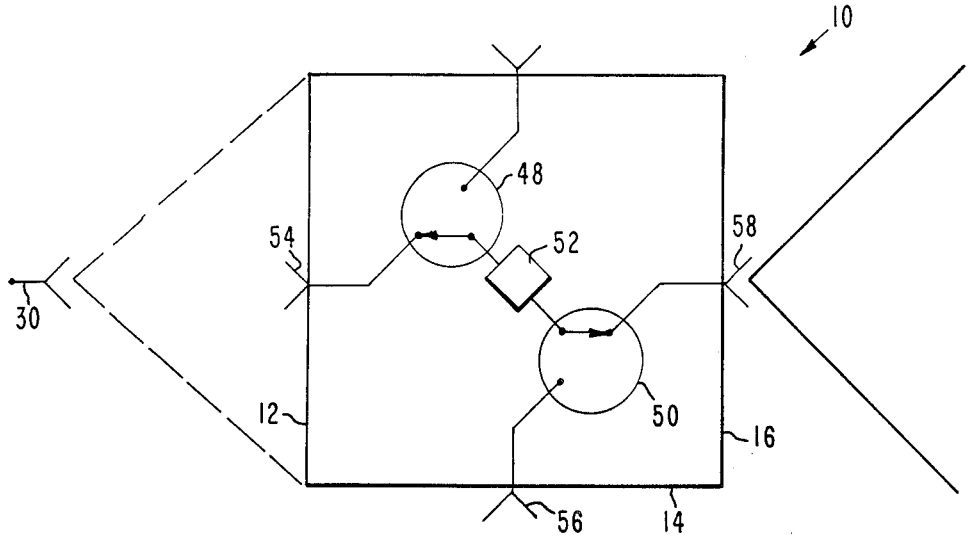
Figure 4B:
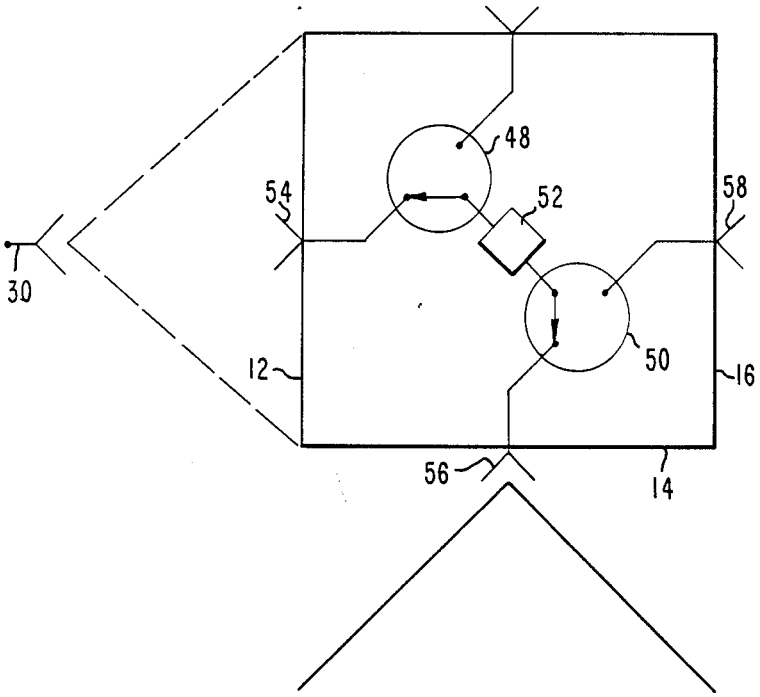
Figure 4C:
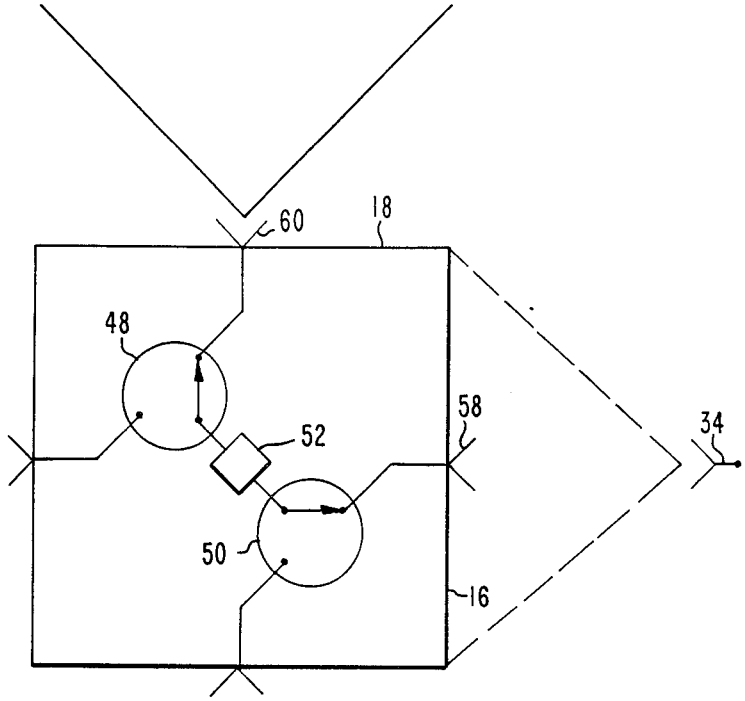
Figure 4D:
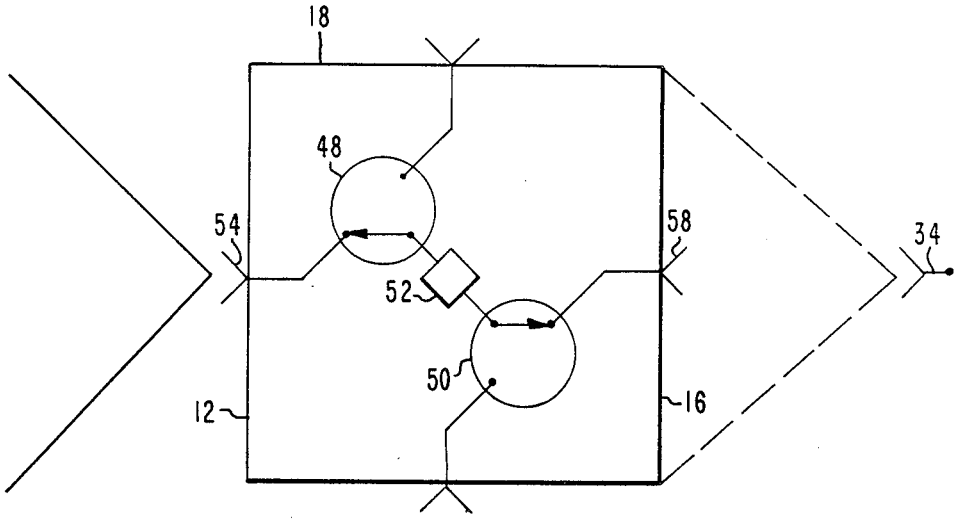
Figure 5:
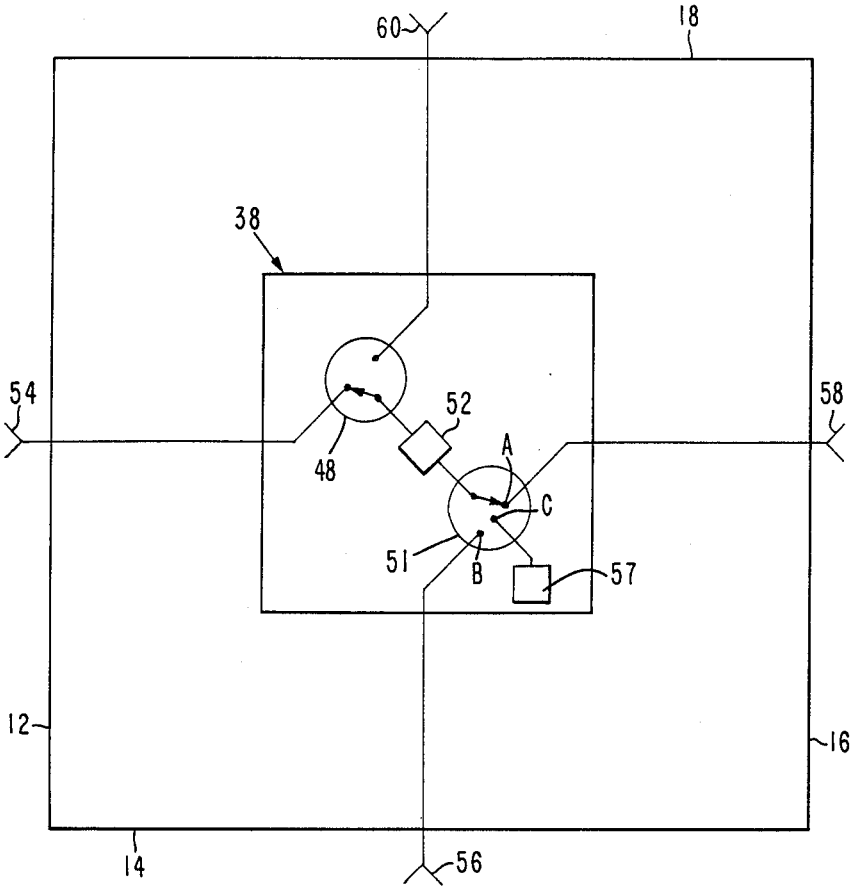
Figure 6:
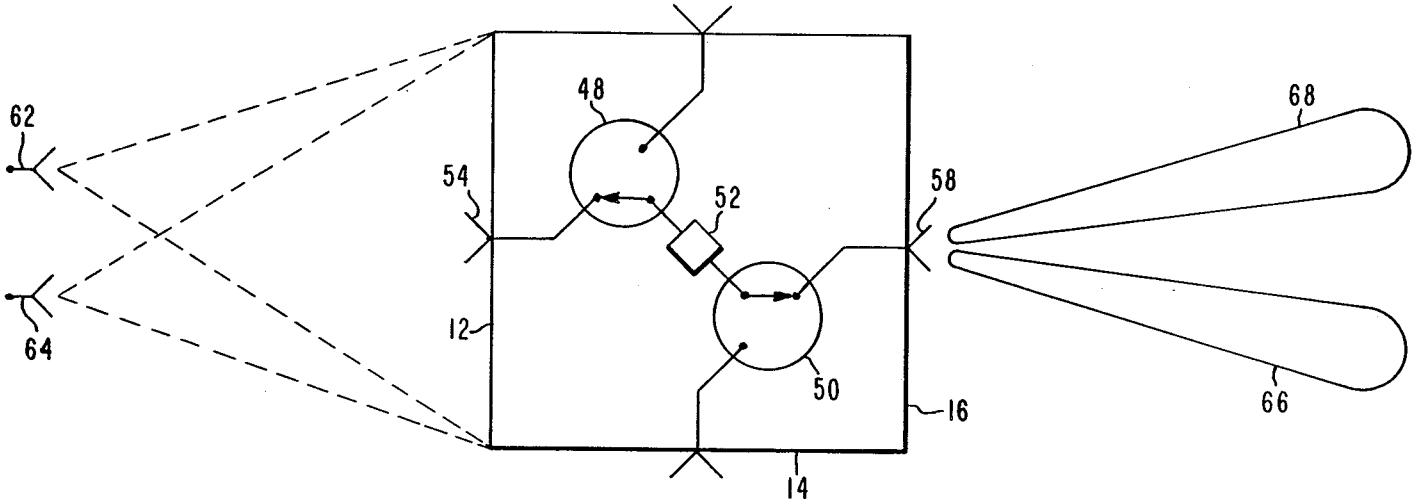
Figure 7:
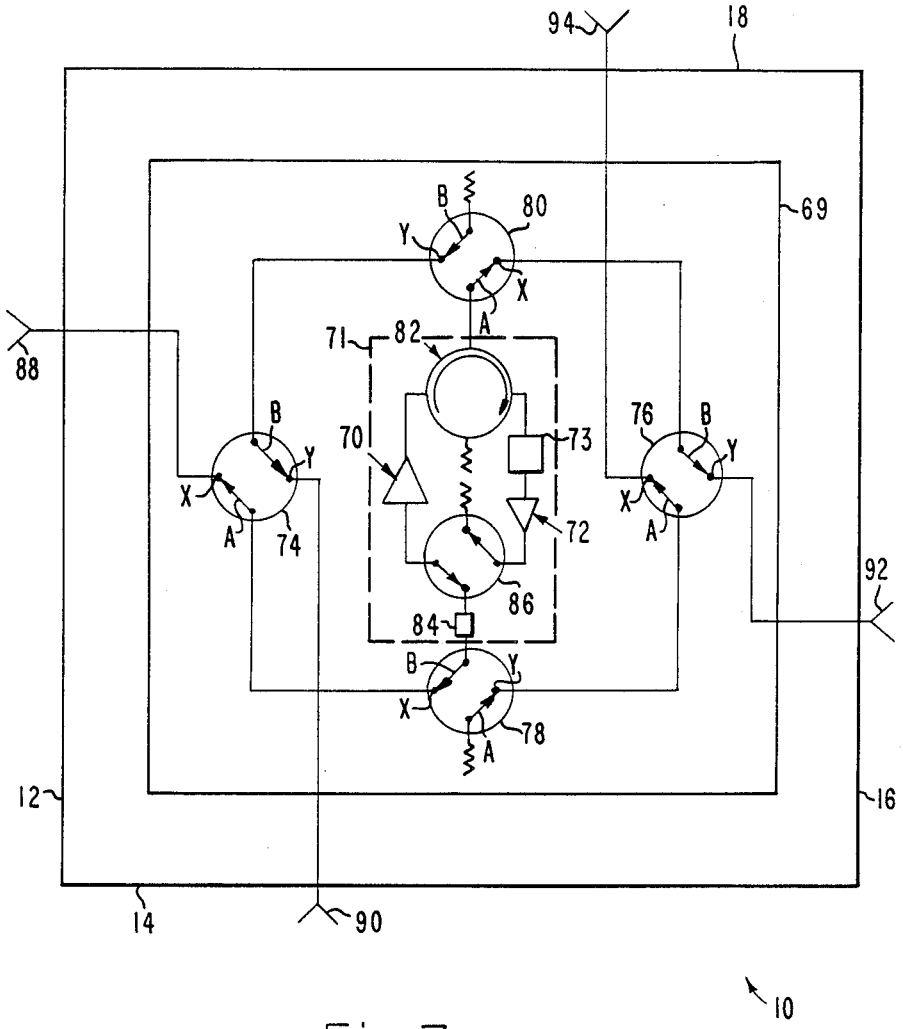
Figure 8:
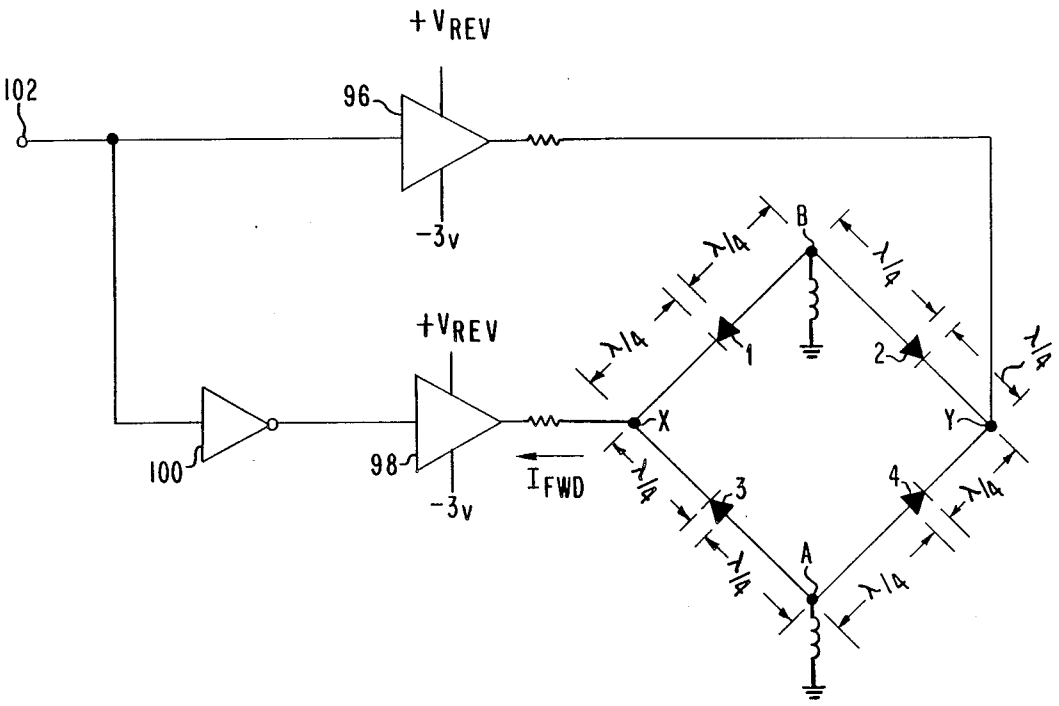

FIGS. *4a–4d* show the operation of the SPDT switches of FIG. 3 in conducting the energy received from a feed horn through the phase shifter and to a selected radiating face;

FIG. 5 is a diagram of an embodiment of the invention showing four radiating elements, a single phase shifter, a SPDT switch, and a single pole triple throw switch (SPTT) for coupling the phase shifter to two radiating elements or to a reflection means;

FIG. 6 is a diagram of an antenna in accordance with the invention showing the simultaneous generation of two beams from the same face;

FIG. 7 presents another embodiment of the invention where transmitting and receiving components are mounted at the lens and DPDT switches are used to connect each radiating element with the other faces; and FIG. 8 is a schematic diagram of a DPDT switch usable in the embodiment of FIG. 7.

DETAILED DESCRIPTION OF THE PREFERRED EMBODIMENTS

In the following description, like reference numerals will be used to refer to like elements in the different figures of the drawings. Referring now to the drawings with more particularity, in FIG. 1 there is shown a perspective view of a lens antenna 10 having four apertures or faces 12, 14, 16, and 18 each of which includes a plurality of radiating elements. In this description, the expression "radiating element" will be used to refer to elements typically capable of radiating and receiving. Since the invention comprises a lens having four apertures all of which are capable of both receiving and radiating, the above expression, i.e., "radiating", will be used for convenience of description only and is not used in a sense to restrict function unless expressly specified.

Figure 1:
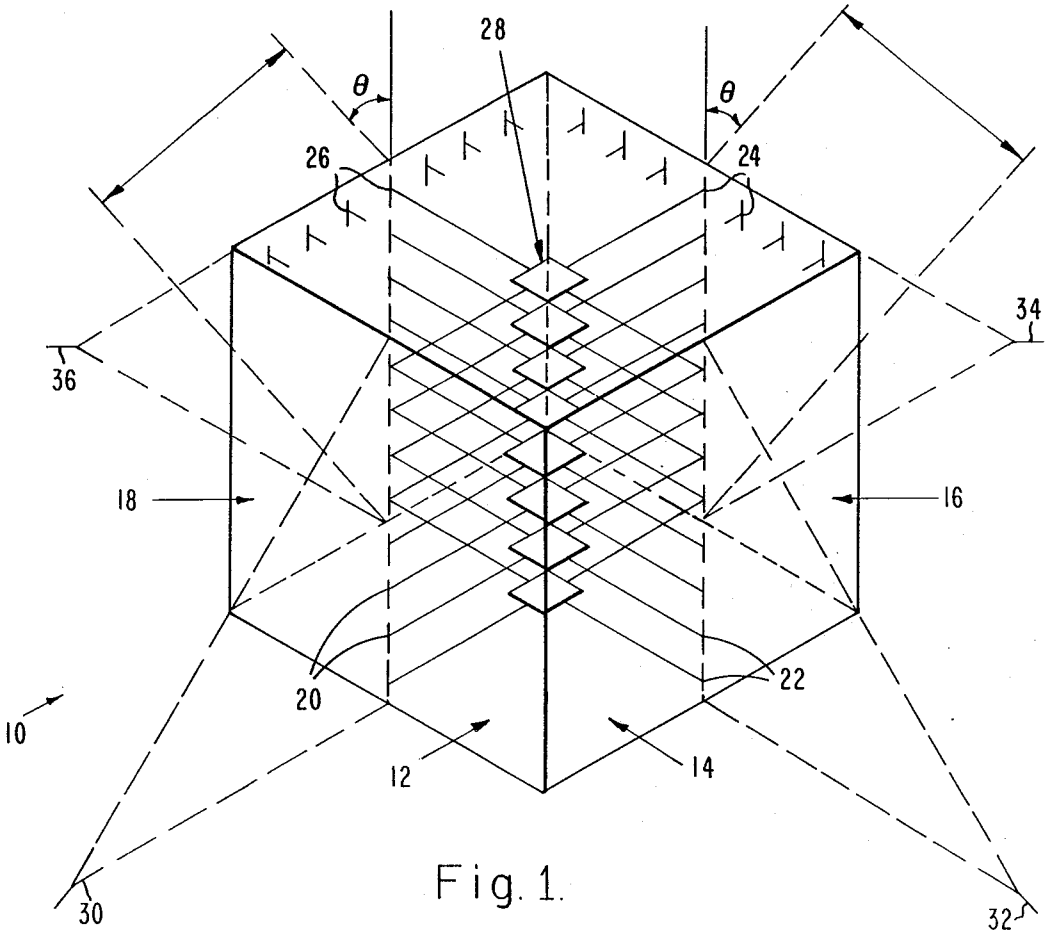
FIG. 1 presents a diagrammatic perspective view of an embodiment of a three dimensional feed through lens in accordance with the invention having four apertures or faces for hemispheric coverage, and showing a plurality of phase shifter means centrally located in the lens, each phase shifter means being interconnected with four radiating elements.

Each face includes a plurality of radiating elements 20, 22, 24, 26. For the purpose of convenience of description, only certain radiating elements have been shown although a fully covered two-dimensional array of radiating elements would typically exist on each face. As is also shown, the lens 10 has been divided into eight horizontal planes which are stacked vertically. Each plane includes four radiating elements, one from each face, and a phase shifting module centrally located and interconnected with those radiating elements. FIG. 1 is a simplified diagram for the purpose of convenience in description only. The typical lens would include many more phase shifting modules and planes than those shown in FIG. 1, depending upon the application.

Reference is now made to the top plane in FIG. 1. In that top plane, one radiating element from each of the faces 12, 14, 16, and 18 has been connected to the phase shifting module 28 which is centrally located. In accordance with the invention, that phase shifting module comprises a single phase shifter and is responsible for controlling the phase shift of the energy for all four of the radiating elements.

Also shown in FIG. 1 are feed horns 30, 32, 34, and 36, one for each face 12, 14, 16, and 18 respectively. These feed horns are used in accordance with well known principles in the art, i.e., a feed horn such as 30 illuminates a face 12, which receives the energy. In prior techniques, this received energy would be phase shifted by the phase shifters of the receiving face, then transferred to the radiating elements of the diametrically opposite face to radiate into space. This prior technology is limited to coverage of only a quarter of a hemisphere. In the invention, the energy received at face 12 would be transferred to the phase shifting module 28 for phase shifting and then transferred to a selected face such as 14 or 16 for radiation. The same operation would occur for the other feed horns 32, 34, and 36 shown in FIG. 1, thus providing coverage of a complete hemisphere. As shown in FIG. 1, the feed horns 30, 32, 34, and 36 are offset from the faces to decrease blockage.

Figure 2:
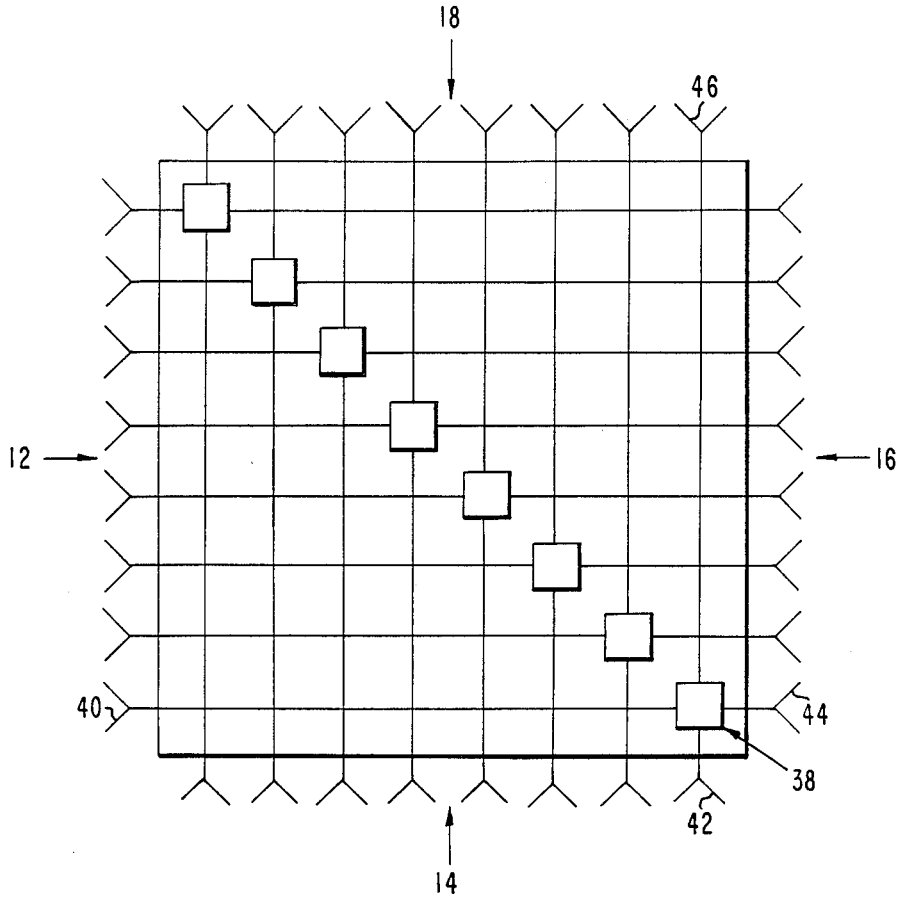
FIG. 2 presents a diagrammatic top view of a series of phase shifter means in one horizontal plane (horizontal cross-section) of a lens in accordance with the invention showing a total of 32 radiating elements (eight radiating elements per antenna face) with 8 phase shifter means, each of which feeds 4 elements.

FIG. 1 presents only a single phase shifting module 28 which is centrally located, however, each plane would probably appear more like that shown in FIG. 2. FIG. 2 presents a top view of a horizontal plane (horizontal cross section) of radiating elements. As in FIG. 1, each of the four faces 12, 14, 16, and 18 have a plurality of radiating elements, there are eight per face in the embodiment shown in FIG. 2. Corresponding radiating elements are interconnected to a single phase shifting module. Interconnection of particular radiating elements is accomplished as shown in FIG. 2. In the case of phase shifting module 38, it interconnects the radiating elements 40, 42, 44, and 46 of sides 12, 14, 16, and 18 respectively. While faces 12 and 14 have their right-most radiating element 40 and 42 respectively connected to the module 38, faces 16 and 18 have their left-most radiating elements 44 and 46 respectively connected to the module 38. This difference may be offset by subsequent signal processing.

Referring now to FIG. 3, an embodiment of a phase shifting module 38 is shown. In this embodiment, two single pole, double throw (SPDT) switches 48 and 50 are shown. Each switch is connected to two faces and to the single phase shifter 52. In the case of switch 48, it is connected to radiating element 54 of face 12 and to radiating element 60 of face 18. It then has the capability of switching either of these radiating elements into the phase shifter 52. Switch 50 likewise has the ability to switch either radiating element 56 of face 14 or radiating element 58 of face 16 into the phase shifter 52. In normal operation, a feed horn 30 such as that shown in FIG. 1 would illuminate a face, such as face 12. The associated switch 48 would be set to couple the energy received by the radiating element 54 at that face 12 to the phase shifter 52. The second switch 50 would be set to couple the phase shifted energy to either of the corresponding radiating elements 56 or 58 on the other two faces 14 or 16 to which the switch is connected. Thus, illumination of one face by a feed horn can result in the scanning of 180 degrees by two other faces. This is more graphically shown in FIGS. *4a–4d* for an embodiment of two feed horns.

In FIG. *4a*, feed horn 30 is energized and illuminates face 12. Switch 48 is a SPDT and is set such that it connects radiating element 54 of side 12 to the phase shifter 52. Switch 50 is SPDT and is set such that it connects the phase shifted energy from phase shifter 52 to radiating element 58 of side 16 thus scanning a ninety degree sector.

In FIG. *4b*, the same feed horn 30 illuminates the same side 12, however, in this case, switch 50 has been set to connect the phase shifted energy to radiating element 56 of side 14. Thus, one side 12 is able to radiate from two other sides in the embodiment of FIGS. *4a* and *4b*. A similar operation is shown in FIGS. *4c* and *4d* where face 16 is illuminated by feed horn 34. Radiating element 58 receives the energy which is transferred to the phase shifter 52 by switch 50 and is switched to either radiating element 60 of face 18 (FIG. *4c*) or radiating element 54 of face 12 (FIG. *4d*). Thus, a full hemisphere may be scanned with a lens antenna and two feed horns 30 and 34 in accordance with the invention.

Further understanding of the invention is possible through an example of the signal flow through the antenna on transmit. On transmit, the signal from the radar transmitter is connected to one of the four feed horns such as feed horn 30 (FIG. *4a*). The selected feed horn 30 in turn illuminates its respective array face 12 of the three dimensional feed-through lens 10. The signals picked up by the radiating element 54 from the selected feed horn 30 are transmitted through the SPDT switches 48 and 50 and phase shifter 52 to the corresponding radiating element 58 which is diametrically opposite across the lens 10 to the illuminated radiating element 54. These signals are then re-radiated by the diametrically opposite element 58 to form a beam in that direction. The angular position of the beam is controlled by the phase settings of the phase shifters in the lens 10. By setting switch 50 to its alternate position, radiation from the face 14 adjacent the illuminated face 12 occurs.

By varying the phase settings of the phase shifters, each antenna face is capable of providing scan coverage over a quarter of a hemisphere. By switching the transmitter signal from one feed horn to the next feed horn, the four ninety-degree spaced apart feed horns (FIG. 1) provide a complete hemispherical coverage.

In the case where only two feed horns are used (FIGS. *4a–4d*) instead of four feed horns (FIG. 1) to provide hemispherical coverage, only a pair of diametrically opposite feed horns 30, 34 are used. In order to accomplish hemispherical coverage, the SPDT switches are switched not only to the diametrically opposite elements but also to those in the antenna face which is positioned ninety-degrees apart as shown in FIGS. *4b–4c*. By using this additional switching the illumination signals from one feed horn excites two ninety-degree spaced apart apertures to provide half of a hemispherical coverage. This simplification, however, requires additional control of the SPDT switches.

A further embodiment is shown in FIG. 5 where switch 51 is a single pole, triple throw (SPTT) switch. One terminal "A" of the switch is connected to radiating element 58, another terminal "B" of the switch is connected to radiating element 56 and a third terminal "C" of the switch is connected to a reflection means 57 such as a signal ground. When switch 51 is set to terminal "C", energy received at face 12 will be reflected back to face 12 for re-radiation. By this embodiment the illumination of one face results in the radiation over a sector of 270 degrees. For reflection back to the same face, the amount of phase shift provided by the phase shifter 52 would be set in most cases to less than one-half since the energy will pass through it twice. This may result in less loss through the phase shifter, however, because typically a whole "bit" will not be used. Typically the 180 degree bit would not be used.

A further embodiment of the invention is shown in FIG. 6 where two beams are created simultaneously from the same face. In this embodiment, two feed horns 62 and 64 simultaneously illuminate face 12. This energy is received by radiating elements on that face 12 such as element 54. The energy is transferred to the diametrically opposite face 16 (as shown) or the adjacent face 14 as desired through switches 48 and 51 and phase shifter 52. The illumination from feed horn 62 results in one radiated beam 66 from face 16 and the illumination from feed horn 64 results in a second radiated beam 68 from the same face 16. Both beams may be steered by the phase shifting means 52.

Another embodiment as shown in FIG. 7 incorporates transmitter and receiver components into the three dimensional feed-through lens 10. In this embodiment, the phase shifting means 69 includes a solid state transmit and receive (T/R) module 71 comprising a high power amplifier 70, a low noise amplifier 72, a duplexing switch 86, a circulator 82, a limiter 73 and a phase shifter 84. The T/R module 71 is placed in close proximity to the radiating elements. The two SPDT switches used in the previous embodiment are replaced by four double pole, double throw (DPDT) switches 74, 76, 78, and 80. In this embodiment, high power generation is placed closer to the radiating aperture in order to minimize transmission losses, and low noise amplification of the received signal is also located closer to the aperture in order to maximize the signal-to-noise ratio. However, these improvements are at the expense of a more complex antenna system.

As also shown in FIG. 7, only a single phase shifter 84 is used. This single phase shifter 84 is located between two DPDT switches 78 and 86 and provides the phase shifting required for the use of any of the four radiating elements 88, 90, 92, and 94. Through certain switch settings, any face can radiate from any of the three other faces.

As an example, illumination of face 12 will be considered. As the switches are set as shown in FIG. 7, the signal received by radiating element 88 will be conducted by switch 74 to switch 78. Switch 78 will conduct the signal to the phase shifter 84 and then to switch 86. From switch 86, the signal is conducted to the high power amplifier 70 and from there through circulator 82, switch 80, and switch 76 to radiating element 92 on face 16. By changing switch 76, the amplified signal would have been conducted for radiation to radiating element 94 on face 18. By changing switch 80, the amplified signal would have been conducted to radiating element 90 on face 14 through switch 74. Further analysis of the various switch settings will show that illumination of any face can result in the radiation from the remaining three faces. A sample table is presented below detailing switch settings (refer to FIG. 7) to achieve the required radiation/reception from selected faces:

TABLE I

| SWITCH SETTINGS WHEN FACE 12 IS ILLUMINATED | | | | | | | | |
|---|---|---|---|---|---|---|---|---|
| TO RADIATE FROM | SWITCH 74 | | SWITCH 80 | | SWITCH 76 | | SWITCH 78 | |
| FACE | A | B | A | B | A | B | A | B |
| 14 | X | Y | Y | X | X | Y | Y | X |
| 16 | X | Y | X | Y | X | Y | Y | X |
| 18 | X | Y | X | Y | Y | X | Y | X |

Switches usable in the invention are well known to those skilled in the art. DPDT switches may take the form of the diode switch arrangement shown in FIG. 8. The diodes 1,2,3,and 4 used may be PIN type and the driver devices 96 and 98 may be NPN transistors. Logic inverter 100 is coupled to driver 98. The logic control signal is input at terminal 102. The following Table II illustrates the switch controls:

TABLE II

| | DIODE STATE | | | |
|---|---|---|---|---|
| SWITCH STATE | 1 | 2 | 3 | 4 |
| A → X, B → Y | OFF | ON | ON | OFF |
| A → Y, B → X | ON | OFF | OFF | ON |

Thus there has been shown and described a new and useful feed through lens. In each of the embodiments presented, only one phase shifter is used for four radiating elements resulting in a savings of approximately seventy-five percent of the total cost of a phased array antenna using prior techniques to provide hemispherical coverage. In the embodiment shown in FIG. 6, only one circulator, a likewise relatively expensive device, was used, resulting in a savings also. Although embodiments have been shown and described in detail, it is anticipated that modifications and variations may occur to those skilled in the art which to not depart from the inventive concepts. It is the intention that the scope of the invention should include such modifications unless specifically limited by the claims.

What is claimed is:

1. A three dimensional lens antenna for providing hemispherical coverage, comprising:

a lens having four faces, each face covering approximately a quarter of a hemisphere and said faces disposed in relation to each other so that approximately a complete hemisphere is covered by the combination of said four faces;

a plurality of radiating elements disposed on each of said faces, said radiating elements being adapted to form beams when energized;

feed means for feeding the radiating elements of a selected face from a position removed from said selected face;

a plurality of interconnetion means each for interconnecting a set of four radiating elements, said four elements comprising one radiating element from each of the four faces, and for applying a selected amount of phase shift to energy received by one of said radiating elements and feeding said phase shifted energy to another of said radiating elements as selected;

wherein said set of four radiating elements comprises first and second sets of two radiating elements, the radiating elements of each of said sets of two being located adjacent one another; and wherein each interconnection means comprises:

a single phase shifter having first and second terminals;

first switch means for selectively coupling the first terminal of the phase shifter to one of a first set of two radiating elements; and second switch means for selectively coupling the second terminal of the phase shifter to one of a second set of two radiating elements.

2. The three dimensional lens antenna of claim 1 wherein said feed means comprises two feed horns, one disposed adjacent one face of the lens for feeding the respective set of radiating elements, and the second feed horn disposed adjacent a second face of the lens for feeding the respective set of radiating elements, the second face being located diametrically opposite the first face, whereby full hemispheric coverage may be provided.

3. The three dimensional lens antenna of claim 1 wherein said feed means comprises two feed horns both of which are located adjacent one face of the lens for feeding the respective set of radiating elements with multiple beams.

4. The three dimensional lens antenna of claim 1 further comprising:

reflection means for reflecting energy; and said second switch means is also for selectively coupling said second terminal of said phase shifter to said reflection means;

whereby energy may be re-radiated from the same face from which it was received.

5. The three dimensional lens antenna of claim 1 wherein each said interconnection means comprises:

transmit/receive means for amplifying and phase shifting energy for radiation by a selected radiating element;

switch means for conducting energy received by the radiating element of any of the four faces to the transmit/receive means for amplification and phase shifting and for conducting said received, phase shifted energy to the radiating element of any of the four faces for radiation to said feed means; and said switch means also for conducting energy received by a radiating element from said feed means to said transmit/receive means for phase shifting and amplification and for conducting said phase shifted, amplified energy to the radiating element of any of said four faces for radiation.

6. The three dimensional lens antenna of claim 5 wherein said set of four radiating elements comprises first and second sets of two radiating elements, the radiating elements of each of said sets of two being located adjacent one another, and wherein each interconnection means comprises:

a single phase shifter having first and second terminals;

and wherein said switch means comprises:

first switch means for selectively coupling the first terminal of the phase shifter to one of a first set of two radiating elements; and second switch means for selectively coupling the second terminal of the phase shifter to one of a second set of two radiating elements.

7. A three dimensional lens antenna for providing hemispherical coverage, comprising:

a lens having four faces, each face covering approximately 90 degrees in azimuth and said faces disposed in relation to each other so that 360 degrees in azimuth is covered by the combination of said four faces;

a plurality of radiating elements disposed on each of said faces, said radiating elements being adapted to form beams when energized;

a feed horn for feeding the radiating elements of a selected face from a position removed and offset from said selected face; and a single phase shifter having first and second terminals;

a plurality of interconnection means each for interconnecting a set of four radiating elements, said four elements comprising one radiating element from each of the four faces, so that any of the four elements may be selectively connected with the first terminal or the second terminal of the single phase shifter, and for applying energy received from the radiating element of a selected face to the first terminal of the phase shifter and for conducting said phase shifted energy from said second terminal to another of said radiating elements.

8. The three dimensional lens antenna of claim 7 wherein said set of four radiating elements comprises first and second sets of two radiating elements, the radiating elements of each of said sets of two being located adjacent each another, and wherein each interconnection means further comprises:

first switch means for selectively coupling the first terminal of the phase shifter to one radiating element of the first set of two radiating elements; and second switch means for selectively coupling the second terminal of the phase shifter to one radiating element of the second set of two radiating elements.

9. The three dimensional lens antenna of claim 7 further comprising a second feed horn, said second feed horn being disposed adjacent the face of the lens diametrically opposite the face adjacent the first feed horn, said second feed horn for feeding the respective set of radiating elements.

10. The three dimensional lens antenna of claim 7 further comprising a second feed horn disposed adjacent the same face of the lens as the first feed horn for feeding the respective set of radiating elements with multiple beams.

11. The three dimensional lens antenna of claim 8 further comprising:

reflection means for reflecting energy; and said second switch means is also for selectively coupling said second terminal of said phase shifter to said reflection means;

whereby energy may be re-radiated from the same face from which it was received.

12. The three dimensional lens antenna of claim 7 wherein each said interconnection means comprises:

transmit/receive means for amplifying energy for radiation by a selected radiating element;

switch means for conducting energy received by the radiating element of any of the four faces to the transmit/receive means for amplification and for conducting said amplified energy to said phase shifter and for conducting said received, phase shifted energy to the radiating element of any of the four faces for radiation to said feed means; and said switch means also for conducting energy received by a radiating element from said feed means to said phase shifter and for conducting said phase shifted energy to said transmit/receive means for amplification and for conducting said phase shifted, amplified energy to the radiating element of any of said four faces for radiation.

13. A three dimensional lens antenna for providing hemispherical coverage, comprising:

a lens having four faces, each face covering approximately 90 degrees in azimuth and said faces disposed in relation to each other so that 360 degrees in azimuth is covered by the combination of said four faces;

a plurality of radiating elements disposed on each of said faces, said radiating elements being adapted to form beams when energized;

a feed horn for feeding the radiating elements of a selected face from a position removed and offset from said selected face; and a plurality of interconnection means each having a single phase shifter having first and second terminals, said interconnection means for interconnecting a set of four radiating elements with said phase shifter, said four elements comprising one radiating element from each of the four faces and said set of four elements comprising first and second sets of two radiating elements, the radiating elements of each of said sets of two being located adjacent one another;

said interconnection means comprising first switch means for selectively coupling the first terminal of the phase shifter to one of the first set of two radiating elements; and second switch means for selectively coupling the second terminal of the phase shifter to one of the second set of two radiating elements.

14. The three dimensional lens antenna of claim 13 further comprising a second feed horn, said second feed horn being disposed adjacent the face of the lens diametrically opposite the face adjacent the first feed horn, said second feed horn for feeding the respective set of radiating elements, the second face being located diametrically opposite the first face.

15. The three dimensional lens antenna of claim 13 further comprising a second feed horn disposed adjacent the same face of the lens as the first feed horn for feeding the respective set of radiating elements with multiple beams.

16. The three dimensional lens antenna of claim 13 further comprising:

reflection means for reflecting energy; and said second switch means is also for selectively coupling said second terminal of said phase shifter to said reflection means;

whereby energy may be re-radiated from the same face from which it was received.

17. The three dimensional lens antenna of claim 13 wherein each said interconnection means comprises:

transmit/receive means for amplifying energy for radiation by a selected radiating element;

switch means for conducting energy received by the radiating element of any of the four faces to the transmit/receive means for amplification and for conducting said amplified energy to said phase shifter and for conducting said received, phase shifted energy to the radiating element of any of the four faces for radiation to said feed means; and said switch means also for conducting energy received by a radiating element from said feed means to said phase shifter and for conducting said phase shifted energy to said transmit/receive means for amplification and for conducting said phase shifted, amplified energy to the radiating element of any of said four faces for radiation.

* * * * *